United States Patent [19]

Bruce

[11] 3,939,910

[45] Feb. 24, 1976

[54] STUFFING BOX AND BLOW OUT PREVENTING DEVICE FOR POLISH RODS OF OIL WELL PUMPING UNITS

[75] Inventor: Albert I. Bruce, Calgary, Canada

[73] Assignee: GAR Industries Ltd., Calgary, Canada

[22] Filed: Dec. 23, 1974

[21] Appl. No.: 535,222

[52] U.S. Cl. ..... 166/84; 251/1 B; 277/59

[51] Int. Cl.[2] ..... E21B 33/03

[58] Field of Search ..... 166/84, 86, 88, 188; 251/1; 277/110, 112, 59, 60

[56] References Cited

UNITED STATES PATENTS

| | | | |
|---|---|---|---|
| 816,284 | 3/1906 | Williamson | 166/84 |
| 1,922,225 | 8/1933 | Wickersham et al. | 251/1 |
| 2,204,310 | 6/1940 | Holmquist | 277/59 |
| 2,458,270 | 1/1949 | Humason | 166/84 |
| 2,507,262 | 5/1950 | McGivern | 166/148 |
| 2,746,709 | 5/1956 | Minor | 251/1 |
| 2,843,349 | 7/1958 | Meyer | 251/1 |
| 2,945,665 | 7/1960 | Regan et al. | 166/84 |
| 3,468,374 | 9/1969 | Reeves | 166/84 |

FOREIGN PATENTS OR APPLICATIONS

| | | | |
|---|---|---|---|
| 825,477 | 10/1969 | Canada | 166/84 |

*Primary Examiner*—James A. Leppink
*Attorney, Agent, or Firm*—Stanley G. Ade

[57] ABSTRACT

A cylindrical tube with a screw threaded packing gland in the upper end carries an upper guide rubber with a plurality of packing rubbers stacked thereabove and engaged by the gland which applies the necessary pressure to seal the polish rod reciprocating within the stuffing box. A blow-out preventor assembly is situated below the upper guide rubber and comprises a cylindrical rubber portion surrounding the polish rod and having O rings sealed adjacent the upper and lower ends of the cylindrical rubber. An annular chamber is formed on the outer surface of the cylindrical rubber between the O rings and communicates with a source of fluid under pressure which can firstly apply pressure to the rubber surrounding the polish rod and shut off the well so that the stuffing box can be serviced and secondly, can act as an automatic blow-out preventor if the polish rod breaks. Further protection is provided by a spring loaded hinged flap valve which is provided at the base of the stuffing box and which snaps shut if the polish rod breaks and disengages from the stuffing box.

14 Claims, 3 Drawing Figures

STUFFING BOX AND BLOW OUT PREVENTING DEVICE FOR POLISH RODS OF OIL WELL PUMPING UNITS

BACKGROUND OF THE INVENTION

This invention relates to new and useful improvements in stuffing boxes and blow-out preventors associated therewith.

Stuffing boxes are used around the polish rod of oil well pumping units, said polish rod being reciprocated by a beam type pump situated above ground. The lower end of the polish rod is connected to a series of rods operating in a casing which in turn extends downwardly through the oil casing to the producing formation. As the polish rod reciprocates, it operates a pump situated at the base of the oil casing adjacent the producing formation and acts to pump oil upwardly to a discharge or flow "T" situated between the lower end of the polish rod and the upper end of the operating rods.

This oil and/or gas is under considerable pressure and the stuffing box is to prevent the oil from squirting past the polish rod during the operation of the pumping unit. However, this stuffing box which includes glands, seals and the like often wears or gives way thus allowing oil to be sprayed over some considerable distance thus polluting not only the atmsophere, but also the surrounding land.

It is therefore necessary periodically to shut down the well so that the stuffing box can be serviced and normally this is an expensive operation inasmuch as the well normally has to be killed and all pressure released.

SUMMARY OF THE INVENTION

The present invention provides a novel stuffing box which is most efficient in operation and which requires little servicing with the exception of lubrication and occasionally tightening the packing gland nut.

However, a blow out preventor assembly is provided below the stuffing box which enables the well to be shut down without killing same in the event that the stuffing box requires servicing.

Furthermore, if the polish rod is removed for servicing or if it breaks and therefore is inadvertently removed from the stuffing box, the blow out preventor can be utilized to shut off the bore of the stuffing box either manually operated or automatically operated.

Finally, an automatic shut off flap valve assembly may be provided at the base of the assembly which closes the bore in the event that the sucker or polish rod breaks and is displaced from the stuffing box.

The principal object and essence of the invention is therefore to provide a device of the character herewithin described which includes a normally constructed stuffing box which is easily serviced and which further more includes a blow out preventor device so that the stuffing box can be isolated from the well for servicing thus eliminating the necessity of killing the well.

Another object of the invention is to provide a device of the character herewithin described which includes an automatic shut off valve assembly in the event that the polish rod breaks and is displaced from the stuffing box assembly.

A yet further object of the invention is to provide a device of the character herewithin described in which the packing rubbers are easily replaced in the field without having to remove the polish rod and which furthermore prevents the packing rubbers from spreading.

A still further object of the invention is to provide a device of the character herewithin described which is simple in construction, economical in manufacture and othewise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures.

DETAILED DESCRIPTION

Figure 1:
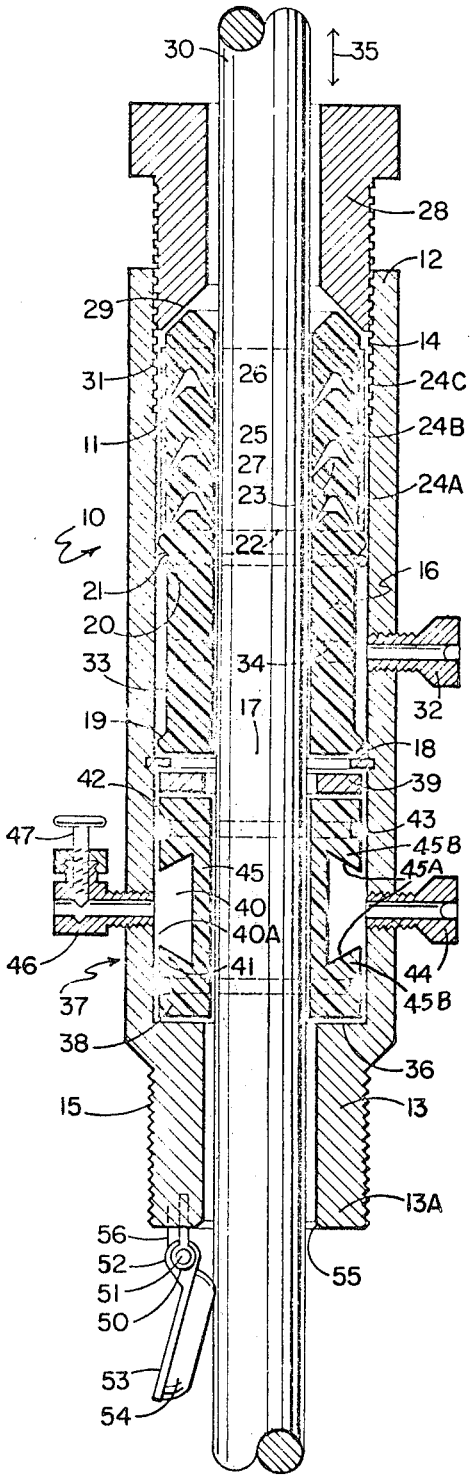
FIG. 1 is a longitudinal section of the stuffing box and blow out preventor device in a common casing.

Proceeding therefore to describe the invention in detail, reference should first be made to FIG. 1 in which reference character 10 illustrates a substantially cylindrical body portion forming the housing for stuffing box aseembly and for the blow out preventor.

This housing is provided with a cylindrical bore 11 extending clear through from one end 12 thereof to the lower end 13 and internal screw threads are provided within the upper end 12 as clearly illustrated.

The lower end 13 reduces in diameter and is provided with external screw threading 15 for attachment to the well pump assembly (not illustrated).

What is conventionally known as an upper guide rubber is provided collectively designated 16 and in this embodiment, this guide rubber is formed from a flexible elastomeric material and is substantially cylindrical in configuration with a bore formed therethrough through which the conventional polish rod 17 extends and reciprocates.

This guide rubber 16 rests upon a snap ring 18 engaging a groove 19 within the bore 11 intermediate the ends of the casing or housing 10 and it will be noted that a bead 19 extends annularly around the lower end of this guide rubber to assist in the sealing characteristics at this point.

An annular groove 20 is formed around the guide rubber adjacent the upper end thereof so that an elastomeric O-ring 21 or the like may engage around the guide rubber and seal against the inner bore 11 of the casing or housing 10.

The upper end 22 of the guide rubber is formed in the shape of an annular cone with the apex 23 thereof extending upwardly when the guide rubber is positioned as shown in FIG. 1.

This guide rubber takes any side strain if the rod is off center and allows the packing rubbers, hereinafter to be described, to float with no strain upon the packing rubbers due to this misalignment.

Situated above the guide rubber 10 is a plurality of packing rubbers collectively designated 24A, B and C.

Each of these are formed from an elastomeric material which is flexible and these ring-like rubbers are provided with an annular convex conical groove 25 on the underside thereof with the upper portion 26 being formed with a truncated conical cross section as clearly illustrated in FIG. 1. When in position, the lowermost rubber 24A rests upon the conical upper surface 23 of the guide rubber and the remaining packing rubbers 24B and 24C in turn rest upon the other ends of the guide rubber immediately therebelow and it will be noted that the angle of the upper conical convex portions of the guide rubber and the packing rubbers is different from the angle of the underside convex grooves so that spaces 27 are provided therebetween. This means that when a gland nut 28 is screw threadably engaged within the screw threads 14, the lowermost coned surface 29 of the gland nut engages the uppermost surface of the packing rubber 24C and gradually forces the packing rubbers downwardly upon the upper end of the guide rubber. The configuration of the upper and lower surfaces hereinbefore described is such that the pressure causes the expansion of these packing rubbers against the polish rod 30 and effectively seals off the stuffing box from the well below.

These packing rubbers which are ring-like in configuration are initially installed with the polish rod 30 removed, but if servicing is required in the field, it is not always convenient to remove the polish rod so that it is conventional that the replacement packing rubbers be slit so that they can be expanded around the polish rod and placed into position whereupon the gland nuts 28 is engaged within the upper end 12 of the housing.

However, if these replacement packing rubbers are split as aforesaid, they tend to spread outwardly and are difficult to compress sufficiently so that an efficient seal is provided.

It has been found therefore that a cylindrical steel sleeve will prevent this spreading action. This steel sleeve designated 31, surrounds the three or more packing rubbers closely, but is spaced from the inner wall 11 of the casing so that it does not interfere with the alignment and sealing action of the packing rubbers.

When replacement rubbers are inserted, the steel sleeve prevents outward expansion thereof thus allowing all the pressure to act inwardly against the polish rod and maintains the floating characteristic of the guide rubbers inasmuch as clearance is provided between the outer surface of the sleeve and the inner wall of the casing.

A lubrication nipple 32 is provided through the wall of the casing adjacent the mid-point of the guide rubber 16 so that lubricant can fill the annular space 33 between the upper O-ring 21 and the lower bead 19 and will work through apertures 34 through the wall of the guide rubber to the polish rod 30, it being understood that this polish rod reciprocates within the stuffing box assembly in the direction of double-headed arrow 35.

An annular shoulder 36 is provided internally of the housing 10 adjacent the lower end 13 thereof and a blow out preventor assembly collectively designated 37, is situated within the housing or casing below the upper guide rubber 16.

This blow out preventor assembly includes a cylindrical elastomeric resilient sleeve 38 which rests upon the shoulder 36 and is retained against upward movement by a steel retainer ring 39 situated below the snap ring 18.

This elastomeric sleeve 38 is provided with an annular recess 40 within the outer wall 41 thereof having a cross sectional shape similar to that shown in FIG. 1. This recess includes an annular inner wall portion 45 and upper and lower side wall portions 45A which incline outwardly and towards one another one from each edge of the inner wall portion thus forming annular wedge portions 45B which are forced outwardly with contact with the inner wall 11 of the housing, when fluid is injected under pressure as will hereinafter be described. Annular grooves 42 are provided within the outer wall 41 above and below this recess 40 and spaced therefrom and resilient O rings or the like 43 engage these grooves and engage against the inner wall 11 of the housing thus acting as an effective seal between the sleeve 38 and the housing so that the recess 40 defines with the inner wall of the housing, a fluid chamber designated 40A.

A fluid injection nipple 44 extends through the wall of the casing and communicates with this fluid chamber 40A so that fluid under pressure may be injected within the chamber and act upon the relatively thin resilient wall portion 45 remaining after the recess portion 40 has been formed in the wall of the sleeve 38.

A relief valve assembly 46 is provided through the wall of the casing also communicating with the fluid chamber 40A and the relief valve 47 may be screwed downwardly to shut off this escape valve assembly.

In operation, and assuming that the well is to be shut down so that the stuffing box assembly can be serviced, the polish rod 30 is stationary and not reciprocating. Fluid under pressure either air or liquid is injected into the fluid injection nipple 44 which forces the wall portion 45 inwardly against the polish rod and completely closes off the gas and/or oil pressure from the well therebelow. This means that the packing gland nut 28 can be removed together with the packing rubbers 24 and, if necessary, the guide rubber 16.

New packing rubbers are inserted within the steel shell 31 whereupon the gland nut is screwed downwardly sufficiently to seal the stuffing box and the fluid pressure can then be removed from the injection nipple 44 with the pressure being relieved through relief valve 47 if necessary.

In the event that it is necessary or desirable to remove the polish rod for servicing purposes, then additional fluid pressure can be injected through the nipple 44 so that when the polish rod is removed, the relatively thin wall 45 collapses completely thus sealing off the bore 11 through the housing 10 without the necessity of killing the well.

If desired, this closing off operation can be made automatic by connecting a cylinder of high-pressure gas to the fluid injection nipple together with means to actuate same in the event that the polish rod breaks and is displaced from the stuffing box housing.

However, it is desirable that a shut off valve assembly be provided and this shut off valve assembly is collectively designated 48.

It is situated on the lower extremity 13A of the housing 10 and is secured thereto by means of a screw threaded bolt 49 engaging within the underside of the housing 10.

This bolt forms a cylindrical portion 50 through which a hinge pin 51 engages, said hinge pin also engaging a pair of spaced and parallel apertured lugs 52 which extend from one side edge of a base plate 53.

Figure 2:
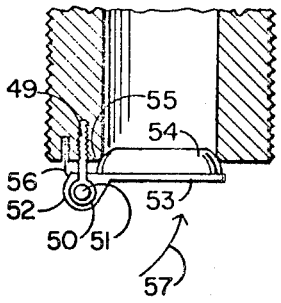
FIG. 2 is a fragmentary longitudinal sectional view of the lower end of the stuffing box casing showing the automatic flap valve in the closed position.

A resilient elastomeric valve seat 54 is secured as by adhesive (not illustrated) to the plate 53 and is shaped as illustrated in FIG. 2.

When in the closed position shown in FIG. 2, it engages a conical valve seat 55 formed around the lower extremity of the bore 11 as clearly shown.

Figure 3:
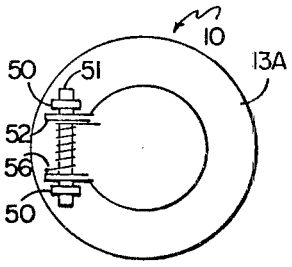
FIG. 3 is an underside view of FIG. 2.

A spring 56 is operatively connected between the housing and the plate 53, being wound around the hinge pin 51 as shown in FIG. 3 and this spring normally biasses or urges the valve plate in the direction of arrow 57.

When the polish rod is in position within the bore of the housing, this spring urges the shut off valve assembly to the position illustrated in FIG. 1 and if the polish rod breaks and is displaced from the stuffing box housing 10, then the spring immediately snaps the valve assembly to the closed position shown in FIG. 2, thus sealing off completely the bore of the housing and preventing any escape of gas and/or oil from the well below. In this connection, the pressure of such gas or oil would assist in maintaining this valve assembly in the closed position.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A stuffing box for polish rods of oil well pumping units comprising in combination a cylindrically bored body portion, a cylindrically bored substantially cylindrical upper guide component formed of resilient elastomeric material situated in said body portion and surrounding the polish rod when said polish rod is positioned within said stuffing box for reciprocation therein, means to support said upper guide component within said body portion, and a plurality of substantially ring-line packing elements of resilient elastomeric material stacked one upon the other and upon the upper end of said guide component and a packing gland nut screw threadably engageable within said body portion and bearing upon the uppermost of said packing elements to compress same in sealing relationship with said guide component and said polish rod and a cylindrical sleeve surrounding said packing elements to enclose and restrain same against outward spreading movement, the diameter of said sleeve being slightly less than the inner diameter of said body portion whereby said packing elements and said sleeve are free floating within said body portion.

2. The invention according to claim 1 which includes a shut-off valve assembly secured to the lower end of said body portion, said shut-off assembly including an annular valve seat surrounding the lower end of the cylindrical bore through said body portion, a frustro conical flexible valve element, a base plate upon which said valve element is secured, means to hinge said base plate by one side edge thereof to base of said body portion whereby when said shut-off valve assembly is in the closed position, said valve element engages said seat thereby shutting off said cylindrical bore through said body portion, and spring means operatively connected between said body portion and said base normally urging said valve element into engagement with said seat, said valve element registering against the side of said polish rod when said polish rod is in position within the bore of said body portion.

3. The invention according to claim 1 in which the upper end of said guide component is conical when viewed in cross section, each of said packing elements having a concave conical under surface and a convex conical upper surface whereby the upper end of said guide component is engaged by the convex under surface of one of said packing elements, the remaining packing elements being engaged one upon the other in wedging relationship, the angle of inclination of the upper and lower conical surfaces being different from one another whereby the packing elements expand upon the polish rod when same are compressed as aforesaid.

4. The invention according to claim 3 which includes a shut-off valve assembly secured to the lower end of said body portion, said shut-off assembly including an annular valve seat surrounding the lower end of the cylindrical bore through said body portion, a frustro conical flexible valve element, a base plate upon which said valve element is secured, means to hinge said base plate by one side edge thereof to base of said body portion whereby when said shut-off valve assembly is in the closed position, said valve element engages said seat thereby shutting off said cylindrical bore through said body portion, and spring means operatively connected between said body portion and said base normally urging said valve element into engagement with said seat, said valve element registering against the side of said polish rod when said polish rod is in position within the bore of said body portion.

5. The invention according to claim 3 which includes a blow-out preventor assembly below said guide component, said blow-out preventor assembly comprising a cylindrically bored resilient elastomeric element normally freely surrounding said polish rod and situated within said body portion, means to restrain said element from upward and downward movement within said body portion, and an annular recess formed in the outer wall of said element defining with the wall of said body portion, an annular fluid chamber, sealing means surrounding said element above and below said recess for sealing off said chamber, fluid conduit means through the wall of said body portion communicating with said chamber for the injection of fluid under pressure to engage said element in sealing relationship with said polish rod and to close off said stuffing box completely if said polish rod is removed.

6. The invention according to claim 5 which includes a shut-off valve assembly secured to the lower end of said body portion, said shut-off assembly including an annular valve seat surrounding the lower end of the cylindrical bore through said body portion, a frustro conical flexible valve element, a base plate upon which said valve element is secured, means to hinge said base plate by one side edge thereof to base of said body portion whereby when said shut-off valve assembly is in the closed position, said valve element engages said seat thereby shutting off said cylindrical bore through said body portion, and spring means operatively connected between said body portion and said base normally urging said valve element into engagement with said seat, said valve element registering against the side of said polish rod when said polish rod is in position within the bore of said body portion.

7. The invention according to claim 5 in which the upper end of said guide component is conical when viewed in cross section, each of said packing elements having a concave conical under surface and a convex conical upper surface whereby the upper end of said guide component is engaged by the convex under surface of one of said packing elements, the remaining packing elements being engaged one upon the other in wedging relationship.

8. The invention according to claim 7 which includes a shut-off valve assembly secured to the lower end of said body portion, said shut-off assembly including an annular valve seat surrounding the lower end of the cylindrical bore through said body portion, a frustro conical flexible valve element, a base plate upon which said valve element is secured, means to hinge said base plate by one side edge thereof to base of said body portion whereby when said shut-off valve assembly is in the closed position, said valve element engages said seat thereby shutting off said cylindrical bore through said body portion, and spring means operatively connected between said body portion and said base normally urging said valve element into engagement with said seat, said valve element registering against the side of said polish rod when said polish rod is in position within the bore of said body portion.

9. The invention according to claim 1 which includes a blow-out preventor assembly below said guide component, said blow-out preventor assembly comprising a cylindrically bored resilient elastomeric element normally freely surrounding said polish rod and situated within said body portion, means to restrain said element from upward and downward movement within said body portion, and an annular recess formed in the outer wall of said element defining with the wall of said body portion, an annular fluid chamber, sealing means surrounding said element above and below said recess for sealing off said chamber, fluid conduit means through the wall of said body portion communicating with said chamber for the injection of fluid under pressure to engage said element in sealing relationship with said polish rod and to close off said stuffing box completely if said polish rod is removed.

10. The invention according to claim 9 which includes a shut-off valve assembly secured to the lower end of said body portion, said shut-off assembly including an annular valve seat surrounding the lower end of the cylindrical bore through said body portion, a frustro conical flexible valve element, a base plate upon which said valve element is secured, means to hinge said base plate by one side edge thereof to base of said body portion whereby when said shut-off valve assembly is in the closed position, said valve element engages said seat thereby shutting off said cylindrical bore through said body portion, and spring means operatively connected between said body portion and said base normally urging said valve element into engagement with said seat, said valve element registering against the side of said polish rod when said polish rod is in position within the bore of said body portion.

11. The invention according to claim 9 in which the upper end of said guide component is conical when viewed in cross section, each of said packing elements having a concave conical under surface and a convex conical upper surface whereby the upper end of said guide component is engaged by the convex under surface of one of said packing elements, the remaining packing elements being engaged one upon the other in wedging relationship.

12. The invention according to claim 11 which includes a shut-off valve assembly secured to the lower end of said body portion, said shut-off assembly including an annular valve seat surrounding the lower end of the cylindrical bore through said body portion, a frustro conical flexible valve element, a base plate upon which said valve element is secured, means to hinge said base plate by one side edge thereof to base of said body portion whereby when said shut-off valve assembly is in the closed position, said valve element engages said seat thereby shutting off said cylindrical bore through said body portion, and spring means operatively connected between said body portion and said base normally urging said valve element into engagement with said seat, said valve element registering against the side of said polish rod when said polish rod is in position within the bore of said body portion.

13. In a stuffing box which includes a cylindrically bored body portion through which a polish rod reciprocates; the improvement comprising a blow-out preventing assembly, said assembly including a cylindrically bored resilient elastomeric substantially cylindrical element normally freely surrounding said polish rod and situated within said body portion, means to restrain said element from upward and downward movement within said body portion, an annular recess formed in the outer wall of said element defining, with the wall of said body portion, an annular fluid chamber, fluid conduit means through the wall of said body portion communicating with said chamber for the injection of fluid under pressure to engage said element in sealing relationship with said polish rod, and to close off said stuffing box completely if said polish rod is removed, said recess being bounded by an inner wall and a pair of side walls one each extending from the upper and lower sides of said inner wall respectively and inclining outwardly from said inner wall towards one another thereby defining annular upper and lower wedge portions which are forced outwardly to contact with said wall of said body portion by the injection of fluid under pressure, and sealing means surrounding said elements above and below said recess for sealing of said chamber.

14. The invention according to claim 13 in which said sealing means on said element includes annular grooves formed around the outer wall of said element on either side of said recess and spaced therefrom, and resilient O rings engaging said recesses.

* * * * *